US006843066B2

(12) United States Patent
Lee et al.

(10) Patent No.: US 6,843,066 B2
(45) Date of Patent: Jan. 18, 2005

(54) AIR CONDITIONING SYSTEM AND METHOD FOR CONTROLLING THE SAME

(75) Inventors: Won Hee Lee, Seoul (KR); Cheol Min Kim, Kyunggi-do (KR); Yoon Jei Hwang, Seoul (KR); Ji Young Jang, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/638,526

(22) Filed: Aug. 12, 2003

(65) Prior Publication Data

US 2004/0107710 A1 Jun. 10, 2004

(30) Foreign Application Priority Data

Dec. 10, 2002 (KR) ..... 10-2002-0078324

(51) Int. Cl.[7] ..... F25B 7/00

(52) U.S. Cl. ..... 62/175; 62/196.1; 62/228.5; 62/229; 62/510

(58) Field of Search ..... 62/175, 160, 199, 62/196.1, 196.2, 229, 228.1, 228.4, 228.5, 510

(56) References Cited

U.S. PATENT DOCUMENTS

| | | | | |
|---|---|---|---|---|
| 5,265,434 | A | * 11/1993 | Alsenz | 62/117 |
| 5,768,903 | A | * 6/1998 | Sekigami et al. | 62/196.2 |
| 6,305,187 | B1 | * 10/2001 | Tsuboe et al. | 62/505 |
| 6,519,957 | B2 | * 2/2003 | Huh et al. | 62/175 |
| 2002/0157409 | A1 | * 10/2002 | Pham et al. | 62/228.3 |
| 2003/0089121 | A1 | * 5/2003 | Wilson et al. | 62/228.3 |
| 2003/0230096 | A1 | * 12/2003 | Hwang | 62/160 |

* cited by examiner

*Primary Examiner*—Marc Norman
(74) *Attorney, Agent, or Firm*—Greenblum & Bernstein, P.L.C.

(57) ABSTRACT

Disclosed are an air conditioning system, in which the total operating capacity of compressors is variably controlled in accordance with a cooling or heating load in a room, and a method for controlling the air conditioning method, thus improving comfortableness in the room, reducing an electric power consumption rate, and increasing cooling or heating efficiency. The air conditioning system includes an indoor heat exchanger for cooling a room by heat-exchanging a refrigerant with air in the room; an outdoor heat exchanger for condensing the refrigerant; a plurality of compressors for compressing the refrigerant; and a control unit for controlling operation of the plural compressors in accordance with the cooling or heating load in the room.

21 Claims, 8 Drawing Sheets

AIR CONDITIONING SYSTEM AND METHOD FOR CONTROLLING THE SAME

BACKGROUND OF THE INVENTION

1. Field of the Invention

The present invention relates to an air conditioning system, and more particularly to an air conditioning system for variably controlling the operating capacity of a plurality of compressors in accordance with a cooling or heating load in a room, and a method for controlling the air conditioning system.

2. Description of the Related Art

Generally, an air conditioning system is an appliance for cooling or heating a room using a refrigerating cycle of a refrigerant compressed by compressors.

The compressor includes a compression unit provided with a compression chamber for compressing the refrigerant, and a motor unit for variably changing the capacity of the compression chamber. In order to meet a trend towards large scale and multi-function applications, the air conditioning system has been developed to comprise two compressors or an inverter-type compressor so that the total capacity of the compressors can be variably changed in accordance with a cooling or heating load in a room, thereby reducing a power consumption rate required to operate the compressors.

FIG. 1 is a schematic view of a conventional air conditioning system in a cooling mode. FIG. 2 is a schematic view of the conventional air conditioning system in a heating mode.

As shown in FIGS. 1 and 2, the conventional air conditioning system comprises first and second indoor heat exchangers 2 and 12 for heat-exchanging a refrigerant with air in a room, thereby cooling or heating the room, first and second outdoor heat exchangers 4 and 14 serving as condensers for condensing the refrigerant in case that the first and second indoor heat exchangers 2 and 12 function as coolers, while serving as evaporators for evaporating the refrigerant in case that the first and second indoor heat exchangers 2 and 12 function as heaters, first and second compressors 6 and 16 for compressing the refrigerant from a low-temperature and low-pressure gaseous state into a high-temperature and high-pressure gaseous state in order to supply the high-temperature and high-pressure gaseous refrigerant to the first and second indoor heat exchangers 2 and 12 or the first and second outdoor heat exchangers 4 and 14, a first expansion device 8 arranged between the first indoor heat exchanger 2 and the first outdoor heat exchanger 4 to expand the refrigerant into a low-temperature and low-pressure state, a second expansion device 18 arranged between the second indoor heat exchanger 12 and the second outdoor heat exchanger 14 to expand the refrigerant into a low-temperature and low-pressure state, and a control unit (not shown) for controlling operation of the first and second compressors 6 and 16. The first indoor heat exchanger 2, the first compressor 6, the first outdoor heat exchanger 4 and the first expansion device 8 are connected by a first refrigerant pipe 9, and the second indoor heat exchanger 12, the second compressor 16, the second outdoor heat exchanger 14 and the second expansion device 18 are connected by a second refrigerant pipe 19.

The reference numerals 7 and 17 respectively denote direction change valves adapted to change the flow direction of the refrigerant so that the air conditioning system can be operated in a cooling or heating mode. The direction change valves 7 and 17 are respectively connected to suction lines 6*a* and 16*a* and discharge lines 6*b* and 16*b* of the first and second compressors 6 and 16, and controlled by the control unit so that the cooling and heating modes of the air conditioning system are selectively established via a single refrigerating cycle of the refrigerant.

That is, the direction change valves 7 and 17 are required to allow the air conditioning system to have both cooling and heating functions. Thus, an air conditioning system having only a cooling function does not require the direction change valves 7 and 17.

Now, the operation of the above-described conventional air conditioning system will be described in detail.

In case that the air conditioning system is operated in a cooling mode and a cooling load in a room to be eliminated is large, as shown in FIG. 1, the control unit operates both of the first and second compressors 6 and 16, and a high-temperature and high-pressure refrigerant discharged from the first and second compressors 6 and 16 is transferred to the first and second outdoor heat exchangers 4 and 14. When the refrigerant passes through the first and second outdoor heat exchangers 4 and 14, the refrigerant is heat-exchanged with the peripheral air, thereby being condensed from a high-temperature and high-pressure gaseous state into a high-temperature and high-pressure liquid state. Then, the condensed refrigerant in the high-temperature and high-pressure liquid state is transferred to the first and second expansion devices 8 and 18. When the condensed refrigerant passes through the first and second expansion devices 8 and 18, the refrigerant is expanded into a low-temperature and low-pressure state and then introduced into the first and second indoor heat exchangers 2 and 12. When the expanded refrigerant passes through the first and second indoor heat exchangers 2 and 12, the refrigerant is heat-exchanged with indoor air, thereby absorbing heat and then being evaporated into a gaseous state. Here, the first and second indoor heat exchangers 2 and 12 function as coolers.

In case that the air conditioning system is operated in the cooling mode and a cooling load in the room to be eliminated is small, the control unit operates only the first compressor 6. A refrigerant discharged from the first compressor 6 circulates along the first outdoor heat exchanger 4, the first expansion device 8, the first indoor heat exchanger 2 and the first compressor 6. Here, the first indoor heat exchanger 2 functions as a cooler.

On the other hand, in case that the air conditioning system is operated in a heating mode and a heating load in a room to be eliminated is large, as shown in FIG. 2, the control unit operates both of the first and second compressors 6 and 16, and a high-temperature and high-pressure refrigerant discharged from the first and second compressors 6 and 16 circulates in the opposite direction of the circulation of the refrigerant in case that that the air conditioning system is operated in the cooling mode and the cooling load to be eliminated is large. Here, the first and second indoor heat exchangers 2 and 12 function as heaters.

In case that the air conditioning system is operated in the heating mode and a heating load in the room to be eliminated is small, the control unit operates only the first compressor 6. A refrigerant discharged from the first compressor 6 circulates along the first indoor heat exchanger 2, the first expansion device 8, the first outdoor heat exchanger 4 and the first compressor 6. Here, the first indoor heat exchanger 2 functions as a heater.

The conventional air conditioning system comprising the first and second compressors 6 and 16 copes with only the current amount of the cooling or heating load in the room. Accordingly, since it is difficult for the conventional air conditioning system to rapidly cope with the variation of the cooling or heating load, the conventional air conditioning system has a limit in improving comfortableness in a room. Further, the conventional air conditioning system comprises two cycles, thus having low cooling and heating efficiency.

In order to rapidly cope with the variation of the cooling or heating load, there has been proposed another conventional air conditioning system comprising a single large-capacity inverter-type compressor (not shown) instead of the first and second compressors 6 and 16. Such a conventional air conditioning system employs the expensive inverter-type compressor and an inverter circuit, thus increasing the production cost.

SUMMARY OF THE INVENTION

Therefore, the present invention has been made in view of the above problems, and it is an object of the present invention to provide an air conditioning system in which the total operating capacity of compressors is variably controlled in accordance with a cooling or heating load in a room, thus improving comfortableness in the room, reducing an electric power consumption rate, and increasing cooling or heating efficiency.

It is another object of the present invention to provide a method for controlling an air conditioning system in which the total operating capacity of compressors is variably controlled to be one selected from 20%, 40%, 50%, 60%, 70%, 80% and 100%, thereby not requiring an inverter-type compressor and an inverter circuit and reducing the production cost of the air conditioning system.

In accordance with one aspect of the present invention, the above and other objects can be accomplished by the provision of an air conditioning system comprising: an indoor heat exchanger for cooling a room by heat-exchanging a refrigerant with air in the room; an outdoor heat exchanger for condensing the refrigerant; a plurality of compressors for compressing the refrigerant; and a control unit for controlling operation of the plural compressors in accordance with a cooling or heating load in the room.

Preferably, the air conditioning system may further comprise a direction change valve for changing the flow direction of the refrigerant so that the air conditioning system is selectively operated in a cooling or heating mode.

Further, preferably, the indoor heat exchanger may include a plurality of unit indoor heat exchangers connected in parallel, and the outdoor heat exchanger may include a plurality of unit outdoor heat exchangers connected in parallel.

The plural compressors may include first and second compressors respectively having a capacity of 30% and third and fourth compressors respectively having a capacity of 20%.

Alternatively, the plural compressors may include four compressors having the same capacity.

The plural compressors may be constant speed compressors.

Alternatively, a part of the plural compressors may be variable capacity compressors, and the rest of the plural compressors may be constant speed compressors.

In accordance with another aspect of the present invention, there is provided a method for controlling an air conditioning system comprising the steps of: (a) determining a cooling or heating load in a room; and (b) controlling operation of first and second compressors respectively having a capacity of 30% and third and fourth compressors respectively having a capacity of 20% in accordance with the determined result in the step (a).

Preferably, the step (b) may include the step of differently controlling the operating modes of the first, second, third and fourth compressors in accordance with a cooling or heating mode.

Further, preferably, the step (a) may include the step of determining the cooling load in the room to be in one grade selected from lowest/low/high/highest grades when the air conditioning system is operated in a cooling mode, and the step (b) may include the step of controlling the operation of the first, second, third and fourth compressors so that the total capacity of the compressors is one selected from 20%, 40%, 60% and 100%.

Moreover, preferably, the step (a) may include the step of determining the heating load in the room to be in one grade selected from lowest/low/high/highest grades when the air conditioning system is operated in a heating mode, and the step (b) may include the step of controlling the operation of the first, second, third and fourth compressors so that the total capacity of the compressors is one selected from 50%, 70%, 80% and 100%.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
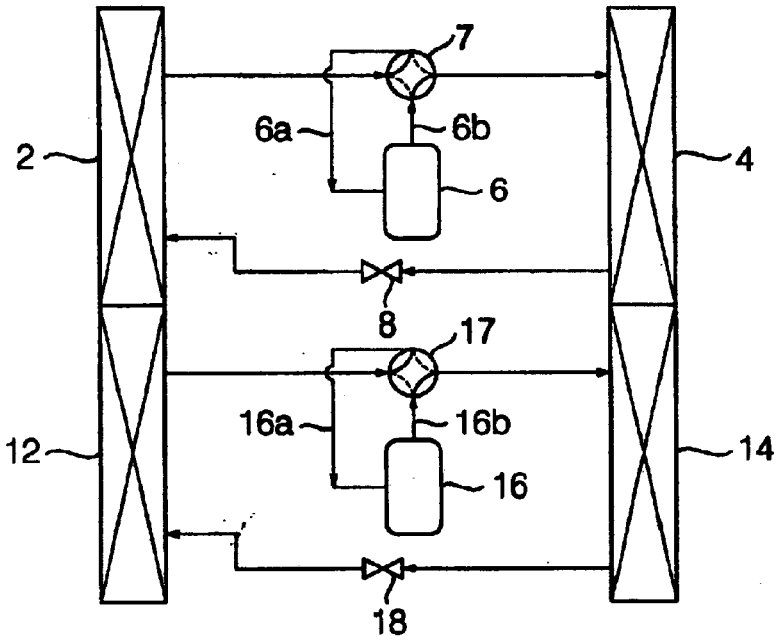
Fig. 1(Prior Art)
FIG. 1 is a schematic view of a conventional air conditioning system in a cooling mode.
Figure 2:
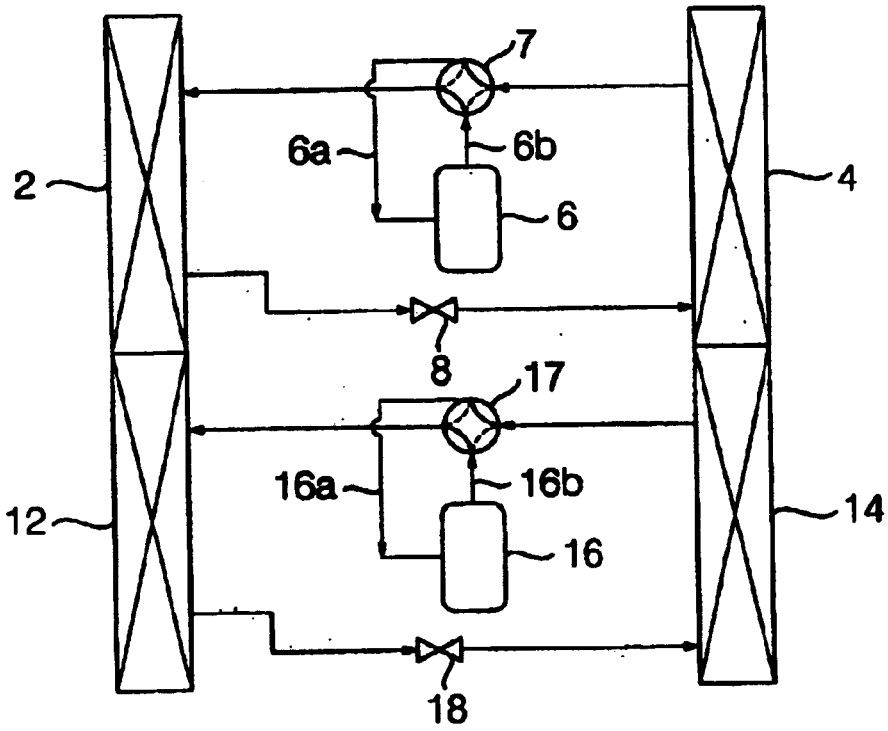
Fig. 2 (Prior Art)
FIG. 2 is a schematic view of the conventional air conditioning system in a heating mode.
Figure 3:
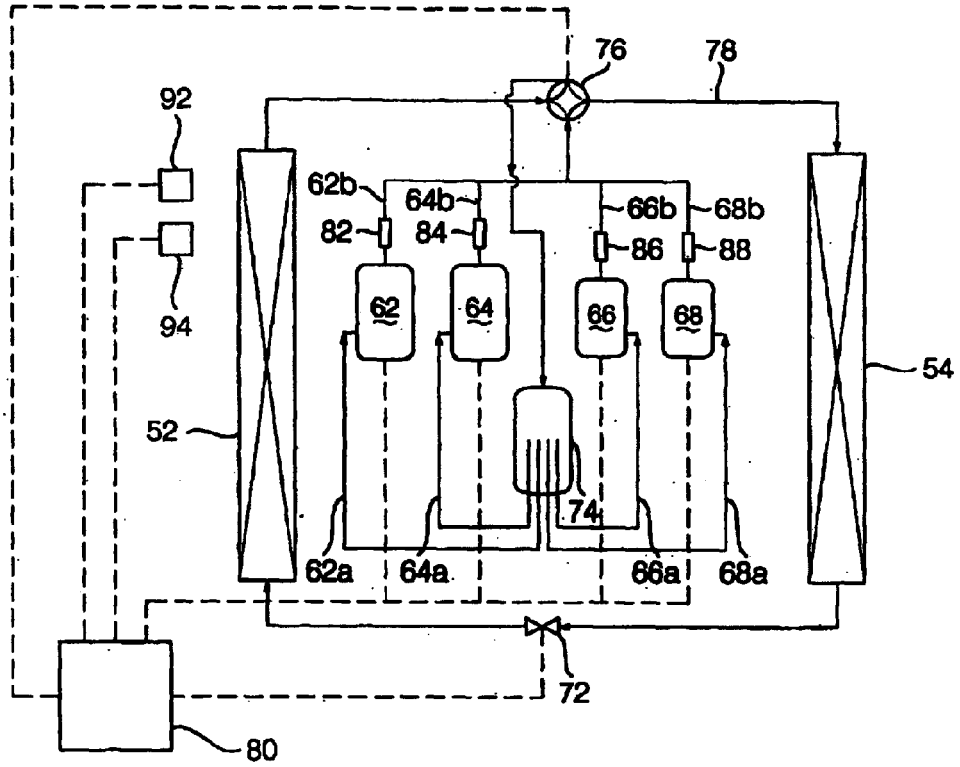
FIG. 3 is a schematic view of one embodiment of an air conditioning system in a cooling mode in accordance with the present invention.
Figure 4:
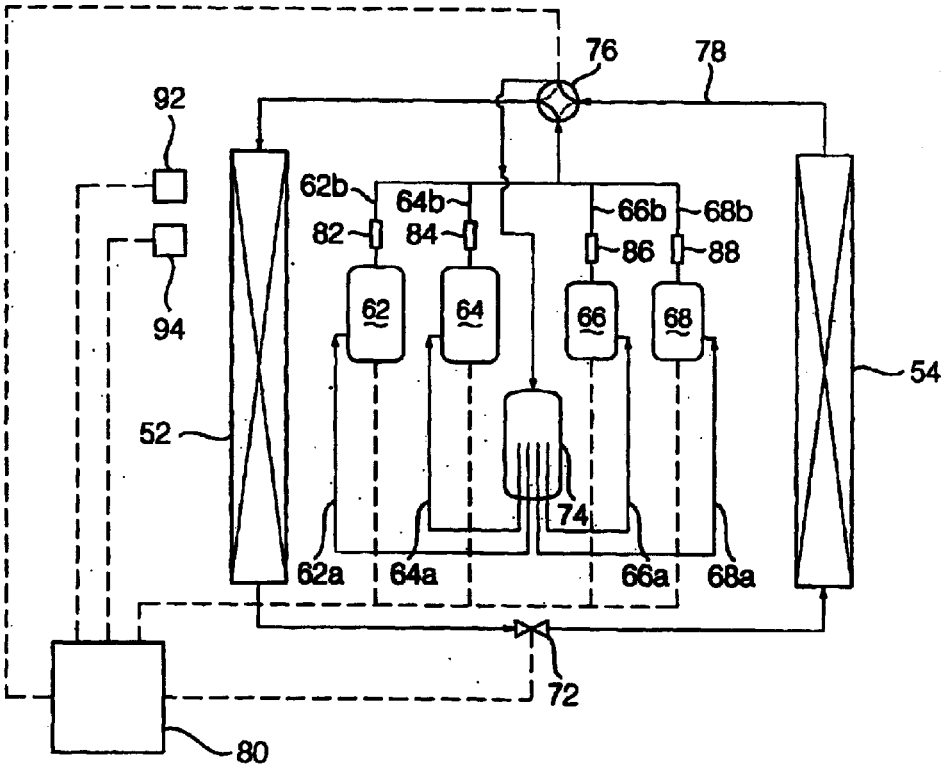
FIG. 4 is a schematic view of one embodiment of the air conditioning system in a heating mode in accordance with the present invention.

FIG. 3 is a schematic view of one embodiment of an air conditioning system in a cooling mode in accordance with the present invention. FIG. 4 is a schematic view of one embodiment of the air conditioning system in a heating mode in accordance with the present invention.

As shown in FIGS. 3 and 4, one embodiment of the air conditioning system in accordance with the present invention comprises an indoor heat exchanger 52 for heat-exchanging a refrigerant with air in a room, thereby cooling the room, an outdoor heat exchanger 54 for condensing the refrigerant, a plurality of compressors, for example, a first compressor 62, a second compressor 64, a third compressor 66 and a fourth compressor 68, for compressing the refrigerant, an expansion device 72 arranged between the indoor heat exchanger 52 and the outdoor heat exchanger 54 to expand the refrigerant, and a control unit 80 for controlling the first, second, third and fourth compressors 62, 64, 66 and 68 in accordance with a cooling load in the room.

The indoor heat exchanger 52, the first, second, third and fourth compressors 62, 64, 66 and 68, the outdoor heat exchanger 54, and the expansion device 72 are connected by a refrigerant pipe 78.

The first, second, third and fourth compressors 62, 64, 66 and 68 may have the same capacity so that the total capacity of operating compressors is controlled to be one selected from 25%, 50%, 75% and 100%. Alternatively, each of the first and second compressors 62 and 64 may have a capacity of 30% and each of the third and fourth compressors 66 and 68 may have a capacity of 20% so that the total capacity of operating compressors is controlled to be one selected from 20%, 40%, 50%, 60%, 70%, 80% and 100%.

Hereinafter, in accordance with preferred embodiments of the present invention, each of the first and second compressors 62 and 64 has the capacity of 30%, and each of the third and fourth compressors 66 and 68 has the capacity of 20%.

Each of the first, second, third and fourth compressors 62, 64, 66 and 68 may be a constant speed compressor, which is generally cheaper than a variable capacity compressor. In this case, it is possible to reduce the total production cost of the air conditioning system. Further, as described above, the total capacity of operating compressors can be controlled to be one selected from 20%, 40%, 50%, 60%, 70%, 80% and 100%, thereby allowing the plural compressors to have the same function as the variable capacity compressor.

Alternatively, a part of the plural compressors, for example, the first compressor 62, may be a variable capacity compressor and the rest of the plural compressors, for example, the second, third and fourth compressors 64, 66 and 68 may be constant speed compressors. In this case, both of the capacity variation by means of the use of the plural constant speed compressors 64, 66 and 68, and the capacity variation by means of the use of the variable capacity compressor 62 are established, thus allowing the air conditioning system to correctly and rapidly cope with the variation of the cooling or heating load in the room.

Hereinafter, in accordance with preferred embodiments of the present invention, each of the first, second, third, and fourth compressors 62, 64, 66 and 68 is the constant speed compressor.

Preferably, the expansion device 72 is an electronic expansion valve, which can control an expansion degree of the refrigerant in response to a control signal of the control unit 80.

The reference numeral 74 denotes a common accumulator to which suction lines 62*a*, 64*a*, 66*a* and 68*a* of the first, second, third and fourth compressors 62, 64, 66 and 68 are connected. This common accumulator 74 serves to store the refrigerant in a liquid state not evaporated by the indoor heat exchanger 52 or the outdoor heat exchanger 54, in order to prevent the liquid refrigerant from being introduced into the first, second, third and fourth compressors 62, 64, 66 and 68. Introduction of such a liquid refrigerant into the first, second, third and fourth compressors 62, 64, 66 and 68 may cause failure of the first, second, third and fourth compressors 62, 64, 66 and 68.

Also, the reference numeral 76 denotes a direction change valve, for example, a 4-way valve, adapted to change the flow direction of the refrigerant in accordance with the control signal from the control unit 80 so that the air conditioning system is used for a cooling or heating purpose. This 4-way valve 76 communicates with the common accumulator 74 and discharge lines 62*b*, 64*b*, 66*b* and 68*b* of the first, second, third and fourth compressors 62, 64, 66 and 68. The 4-way valve 76 guides the high-temperature and high-pressure gaseous refrigerant compressed by the first, second, third and fourth compressors 62, 64, 66 and 68 to the outdoor heat exchanger 54 in a cooling mode, while it guides the same gaseous refrigerant to the indoor heat exchanger 52 in a heating mode.

That is, the 4-way valve 76 is required to allow the air conditioning system to have both cooling and heating functions. Thus, an air conditioning system having only a cooling function does not require the 4-way valve 76.

The reference numerals 82, 84, 86 and 88 denote check valves respectively installed in the discharge lines 62*b*, 64*b*, 66*b* and 68*b* of the first, second, third and fourth compressors 62, 64, 66 and 68. The check valves 82, 84, 86 and 88 serve to prevent the refrigerant discharged from the currently-operating compressors, for example, the first and second compressors 62 and 64, from being introduced into the currently-stopped compressors, for example, the third and fourth compressors 66 and 68.

The control unit 80 can differently control operating modes of the first, second, third and fourth compressors 62, 64, 66 and 68 in accordance with the cooling or heating mode.

In the cooling mode of the air conditioning system, the control unit 80 controls the operation of the first, second, third and fourth compressors 62, 64, 66 and 68 in accordance with a cooling load in the room so that the total operating capacity of the first, second, third and fourth compressors 62, 64, 66 and 68 is one selected from 20%, 40%, 60% and 100%.

That is, the control unit 80 divides the cooling load in the room into four grades. In case that the cooling load in the room to be eliminated is in the lowest grade, the control unit 80 operates only one of the third and fourth compressors 66 and 68. In case that the cooling load in the room to be eliminated is in the low grade, the control unit 80 operates the third and fourth compressors 66 and 68. In case that the cooling load in the room to be eliminated is in the high grade, the control unit 80 operates the first and second compressors 62 and 64. In case that the cooling load in the room to be eliminated is in the highest grade, the control unit 80 operates all of the first, second, third and fourth compressors 62, 64, 66 and 68.

In the heating mode of the air conditioning system, the control unit 80 controls the operation of the first, second, third and fourth compressors 62, 64, 66 and 68 in accordance with a heating load in the room so that the total operating capacity of the first, second, third and fourth compressors 62, 64, 66 and 68 is one selected from 50%, 70%, 80% and 100%.

That is, the control unit 80 divides the heating load in the room into four grades. In case that the heating load in the room to be eliminated is in the lowest grade, the control unit 80 operates one of the first and second compressors 62 and 64, and one of the third and fourth compressors 66 and 68. In case that the heating load in the room to be eliminated is in the low grade, the control unit 80 operates one of the first and second compressors 62 and 64, and the third and fourth compressors 66 and 68. In case that the heating load in the room to be eliminated is in the high grade, the control unit 80 operates the first and second compressors 62 and 64, and one of the third and fourth compressors 66 and 68. In case that the heating load in the room to be eliminated is in the highest grade, the control unit 80 operates all of the first, second, third and fourth compressors 62, 64, 66 and 68.

Here, the reference numeral 92 denotes an operating panel for allowing a user to manipulate the operation of the air conditioning system in the cooling/heating mode and to input a desired target temperature, and the reference numeral 94 denotes a temperature sensor for measuring a room temperature.

Now, the function of the above-described air conditioning system and the method for controlling the system will be described.

Figure 5:
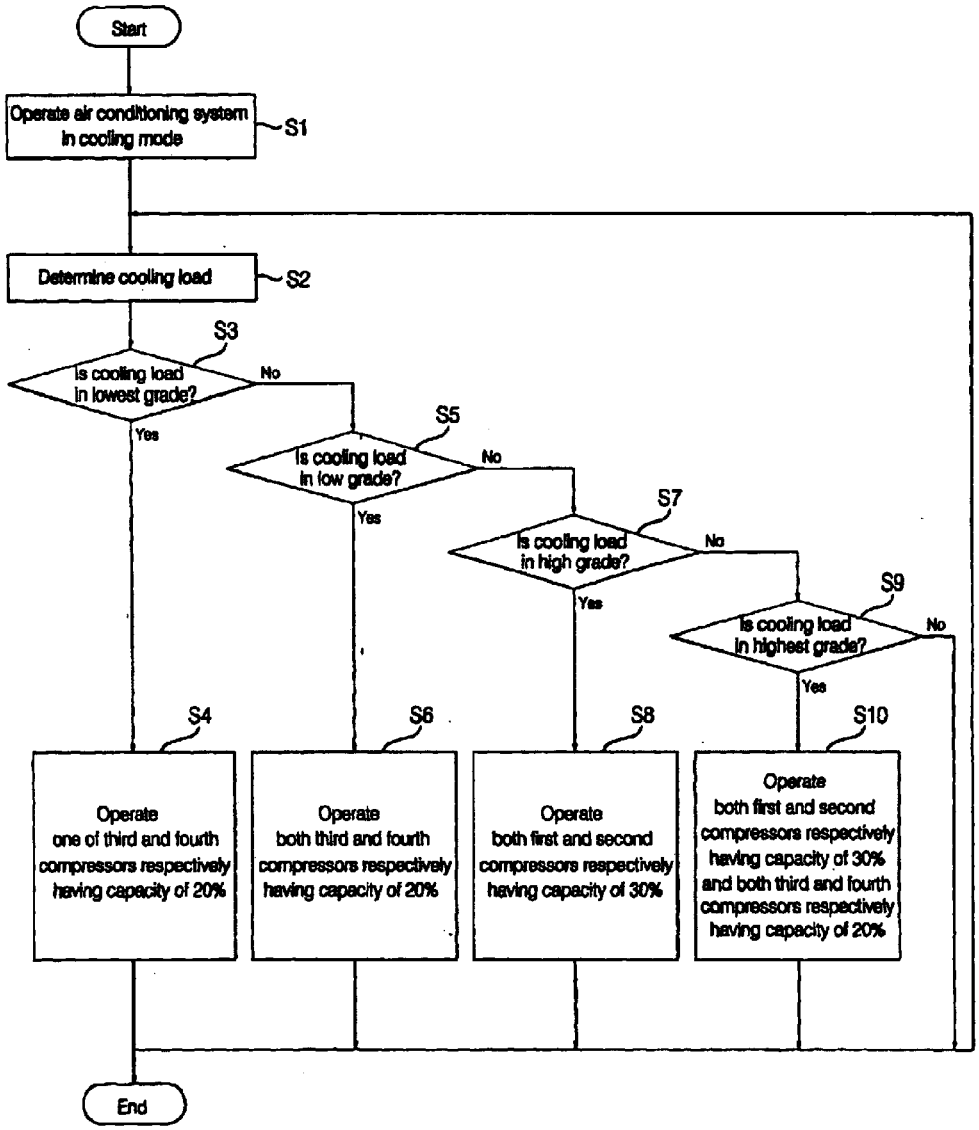
FIG. 5 is a flow chart of one embodiment of a method for controlling an air conditioning system of the present invention in a cooling mode.

FIG. 5 is a flow chart of one embodiment of a method for controlling an air conditioning system of the present invention in a cooling mode.

As shown in FIGS. 3 and 5, the air conditioning system is set to be operated in a cooling mode under the condition in which a target temperature is set, in accordance with the manipulation of the operating panel 92 by a user. Then, the control unit 80 switches the operating position of the 4-way valve 76 to correspond to the cooling mode, and continuously determines a cooling load in the room (S1 and S2).

Preferably, the control unit 80 determines the cooling load in the room using a room temperature sensed by the temperature sensor 94 and the target temperature inputted via the operating panel 92. The control unit 80 determines the cooling load in the room to be one of the lowest/low/high/highest grades.

For example, when a difference value obtained by comparing the room temperature with an allowable range of the target temperature is less than 0.5° C., it is determined that the cooling load in the room is in the lowest grade. When the difference value is less than 1° C., it is determined that the cooling load in the room is in the low grade. When the difference value is less than 1.5° C., it is determined that the cooling load in the room is in the high grade. When the difference value is not less than 2° C., it is determined that the cooling load in the room is in the highest grade.

The control unit 80 controls the operation of the first, second, third and fourth compressors 62, 64, 66 and 68 in accordance with the above-determined grades of the cooling load in the room so that the total operating capacity of the first, second, third and fourth compressors 62, 64, 66 and 68 is one selected from 20%, 40%, 60% and 100%.

That is, when the cooling load in the room is in the lowest grade, the control unit 80 operates only one of the third and fourth compressors 66 and 68, for example, the third compressor 66, and stops the rest of the compressors, for example, the first, second and fourth compressors 62, 64 and 68, so that the total operating capacity of the first, second, third and fourth compressors 62, 64, 66 and 68 is 20% (S3 and S4).

Here, the third compressor 66 discharges a refrigerant in a high-temperature and high-pressure gaseous state. The refrigerant is introduced into the outdoor heat exchanger 54 under the condition in which the check valves 82, 84 and 88 installed in the discharge lines 62*b*, 64*b* and 68*b* of the stopped first, second and fourth compressors 62, 64 and 68 prevent the refrigerant discharged from the operating third compressor 66 from being introduced into the stopped first, second and fourth compressors 62, 64 and 68. The refrigerant passing through the outdoor heat exchanger 54 is heat-exchanged with the peripheral air, thereby being condensed into a high-temperature and high-pressure liquid state. The refrigerant in the high-temperature and high-pressure liquid state condensed by the outdoor heat exchanger 54 passes through the expansion device 72, thereby being expanded into a low-temperature and low-pressure state. Then, the refrigerant is introduced into the indoor heat exchanger 52. When the refrigerant passes through the indoor heat exchanger 52, the refrigerant in the low-temperature and low-pressure liquid state is heat-exchanged with air in a room, thus absorbing heat and then being evaporated. Here, the indoor heat exchanger 52 serves as a cooler. The refrigerant passes through the accumulator 74, and then is introduced again into the operating third compressor 66. Thereby, a cooling cycle is established.

When the cooling load in the room is in the low grade, the control unit 80 operates the third and fourth compressors 66 and 68, and stops the first and second compressors 62 and 64, so that the total operating capacity of the first, second, third and fourth compressors 62, 64, 66 and 68 is 40% (S5 and S6).

Here, each of the third and fourth compressors 66 and 68 discharges a refrigerant in a high-temperature and high-pressure gaseous state. The refrigerants are combined and then introduced into the outdoor heat exchanger 54 under the condition in which the check valves 82 and 84 installed in the discharge lines 62*b* and 64*b* of the stopped first and second compressors 62 and 64 prevent the refrigerant discharged from the operating third and fourth compressors 66 and 68 from being introduced into the stopped first and second compressors 62 and 64. The same as the case in which the cooling load in the room is in the lowest grade, the combined refrigerant passes through the outdoor heat exchanger 54, the expansion device 72, and the indoor heat exchanger 52 sequentially so that the indoor heat exchanger 52 copes with the cooling load in the room.

When the cooling load in the room is in the high grade, the control unit 80 operates the first and second compressors 62 and 64, and stops the third and fourth compressors 66 and 68, so that the total operating capacity of the first, second, third and fourth compressors 62, 64, 66 and 68 is 60% (S7 and S8). Each of the first and second compressors 62 and 64 discharges a refrigerant in a high-temperature and high-pressure gaseous state. The refrigerants are combined and then pass through the outdoor heat exchanger 54, the expansion device 72, and the indoor heat exchanger 52 sequentially so that the indoor heat exchanger 52 copes with the cooling load in the room.

When the cooling load in the room is in the highest grade, the control unit 80 operates all of the first, second, third and fourth compressors 62, 64, 66 and 68, so that the total operating capacity of the first, second, third and fourth compressors 62, 64, 66 and 68 is 100% (S9 and S10). Each of the first, second, third and fourth compressors 62, 64, 66 and 68 discharges a refrigerant in a high-temperature and high-pressure gaseous state. The refrigerants are combined and then pass through the outdoor heat exchanger 54, the expansion device 72, and the indoor heat exchanger 52 sequentially so that the indoor heat exchanger 52 copes with the cooling load in the room.

Figure 6:
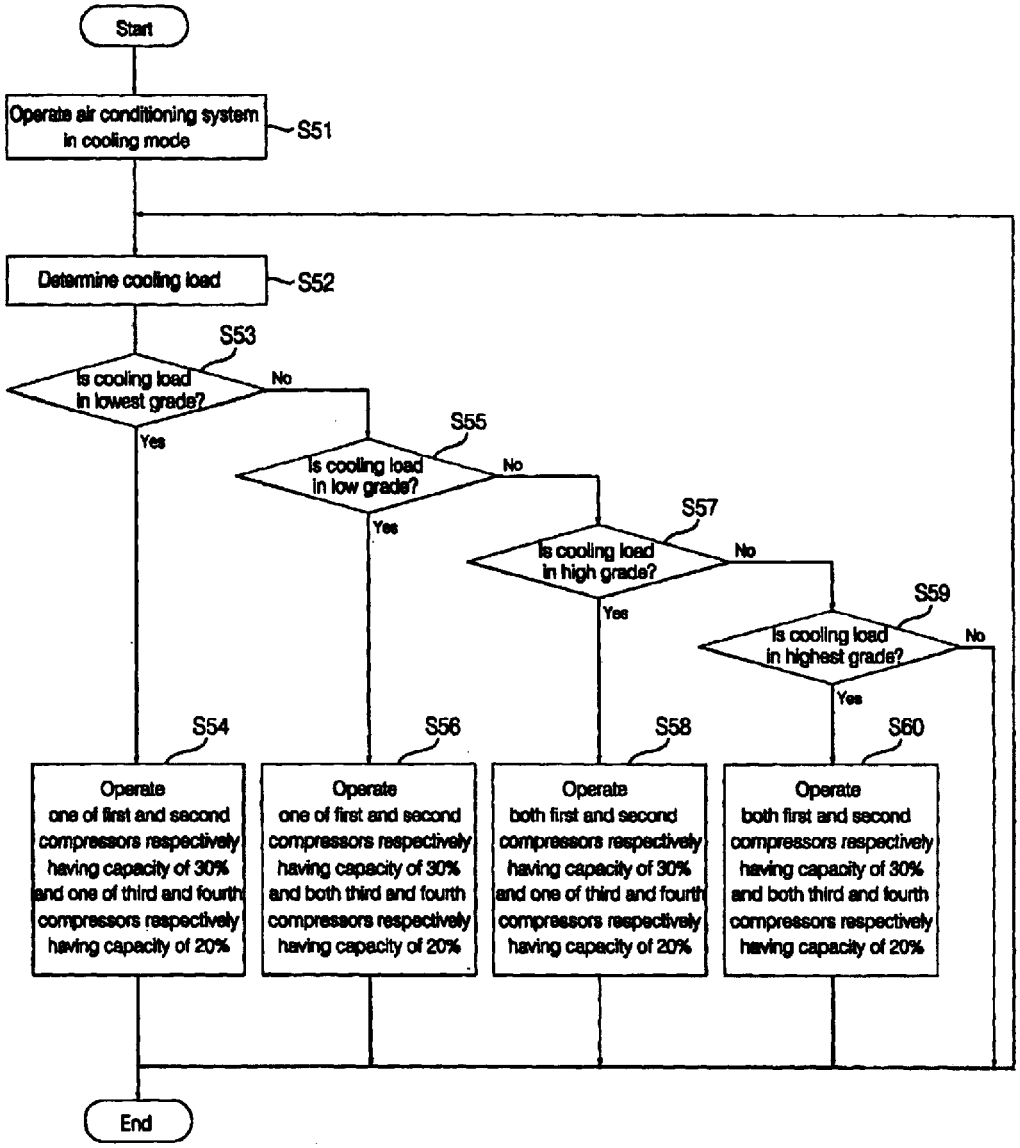
FIG. 6 is a flow chart of one embodiment of a method for controlling the air conditioning system of the present invention in a heating mode.

FIG. 6 is a flow chart of one embodiment of a method for controlling the air conditioning system of the present invention in a heating mode.

As shown in FIGS. 4 and 6, the air conditioning system is set to be operated in a heating mode under the condition in which a target temperature is set, in accordance with the manipulation of the operating panel 92 by a user. Then, the control unit 80 switches the operating position of the 4-way valve 76 to correspond to the heating mode, and continuously determines a heating load in the room (S51 and S52).

Preferably, the control unit 80 determines the heating load in the room using a room temperature sensed by the temperature sensor 94 and the target temperature inputted via the operating panel 92. The control unit 80 determines the heating load in the room to be one of the lowest/low/high/highest grades.

For example, when a difference value obtained by comparing the room temperature with an allowable range of the target temperature is less than 0.5° C., it is determined that the heating load in the room is in the lowest grade. When the difference value is less than 1° C., it is determined that the heating load in the room is in the low grade. When the difference value is less than 1.5° C., it is determined that the heating load in the room is in the high grade. When the difference value is not less than 2° C., it is determined that the heating load in the room is in the highest grade.

The control unit 80 controls the operation of the first, second, third and fourth compressors 62, 64, 66 and 68 in accordance with the above-determined grades of the heating load in the room so that the total operating capacity of the first, second, third and fourth compressors 62, 64, 66 and 68 is one selected from 50%, 70%, 80% and 100%.

That is, when the heating load in the room is in the lowest grade, the control unit 80 operates one of the first and second compressors 62 and 64, for example, the first compressor 62, and one of the third and fourth compressors 66 and 68, for example, the third compressor 66, so that the total operating capacity of the first, second, third and fourth compressors 62, 64, 66 and 68 is 50% (S53 and S54).

Here, each of the operating first and third compressors 62 and 66 discharges a refrigerant in a high-temperature and high-pressure gaseous state. The refrigerants are combined and then introduced into the indoor heat exchanger 52 under the condition in which the check valves 84 and 88 installed in the discharge lines 64*b* and 68*b* of the stopped second and fourth compressors 64 and 68 prevent the refrigerant discharged from the operating first and third compressors 62 and 66 from being introduced into the stopped second and fourth compressors 64 and 68. The refrigerant passing through the indoor heat exchanger 52 is heat-exchanged with air in a room, thereby radiating heat to the room and being condensed into a high-temperature and high-pressure liquid state. Here, the indoor heat exchanger 52 serves as a heater. The refrigerant in the high-temperature and high-pressure liquid state condensed by the indoor heat exchanger 52 passes through the expansion device 72, thereby being expanded into a low-temperature and low-pressure state. Then, the refrigerant is introduced into the outdoor heat exchanger 54. When the refrigerant passes through the outdoor heat exchanger 54, the refrigerant in the low-temperature and low-pressure liquid state is heat-exchanged with peripheral air, thus absorbing heat and then being evaporated into a gaseous state. The refrigerant passes through the accumulator 74, and then is introduced again into the operating first and third compressors 62 and 66. Thereby, a heating cycle is established.

When the heating load in the room is in the low grade, the control unit 80 operates one of the first and second compressors 62 and 64, for example, the first compressor 62, and the third and fourth compressors 66 and 68, and stops the rest of the compressors, for example, the second compressor 64, so that the total operating capacity of the first, second, third and fourth compressors 62, 64, 66 and 68 is 70% (S55 and S56).

Here, each of the first, third and fourth compressors 62, 66 and 68 discharges a refrigerant in a high-temperature and high-pressure gaseous state. The refrigerants are combined and then introduced into the indoor heat exchanger 52 under the condition in which the check valve 84 installed in the discharge line 64*b* of the stopped second compressor 64 prevents the refrigerants discharged from the operating first, third and fourth compressors 62, 66 and 68 from being introduced into the stopped second compressor 64. The same as the case in which the heating load in the room is in the lowest grade, the combined refrigerant passes through the indoor heat exchanger 52, the expansion device 72, and the outdoor heat exchanger 54 sequentially so that the indoor heat exchanger 52 copes with the heating load in the room.

When the heating load in the room is in the high grade, the control unit 80 operates the first and second compressors 62 and 64, and one of the third and fourth compressors 66 and 68, for example, the third compressor 66, and stops the rest of the compressors, for example, the fourth compressor, so that the total operating capacity of the first, second, third and fourth compressors 62, 64, 66 and 68 is 80% (S57 and S58).

Each of the first, second and third compressors 62, 64 and 66 discharges a refrigerant in a high-temperature and high-pressure gaseous state. The refrigerants are combined and then introduced into the indoor heat exchanger 52 under the condition in which the check valve 88 installed in the discharge line 68*b* of the stopped fourth compressor 68 prevents the refrigerants discharged from the operating first, second and third compressors 62, 64 and 66 from being introduced into the stopped fourth compressor 68. The same as the case in which the heating load in the room is in the lowest or low grade, the combined refrigerant passes through the indoor heat exchanger 52, the expansion device 72, and the outdoor heat exchanger 54 sequentially so that the indoor heat exchanger 52 copes with the heating load in the room.

When the heating load in the room is in the highest grade, the control unit 80 operates all of the first, second, third and fourth compressors 62, 64, 66 and 68, so that the total operating capacity of the first, second, third and fourth compressors 62, 64, 66 and 68 is 100% (S59 and S60).

Each of the first, second, third and fourth compressors 62, 64, 66 and 68 discharges a refrigerant in a high-temperature and high-pressure gaseous state. The refrigerants are combined. The same as the case in which the heating load in the room is in the lowest, low, or high grade, the combined refrigerant passes through the indoor heat exchanger 52, the expansion device 72, and the outdoor heat exchanger 54 sequentially so that the indoor heat exchanger 52 copes with the heating load in the room.

Figure 7:
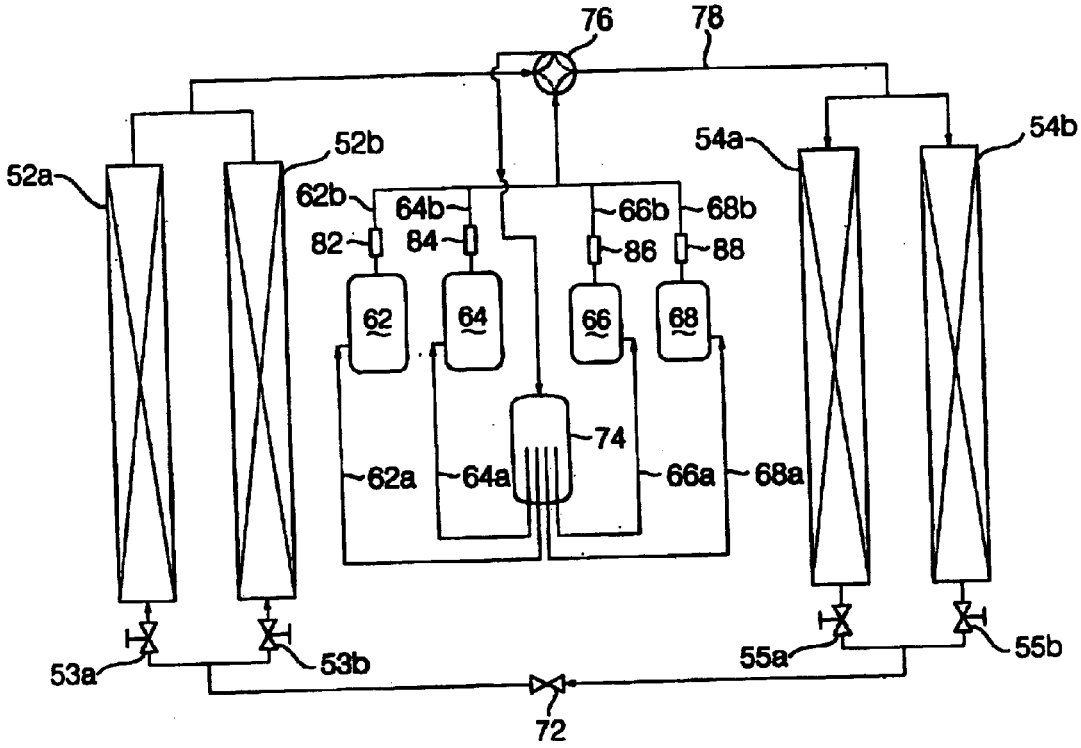
FIG. 7 is a schematic view of another embodiment of the air conditioning system in a cooling mode in accordance with the present invention.
Figure 8:
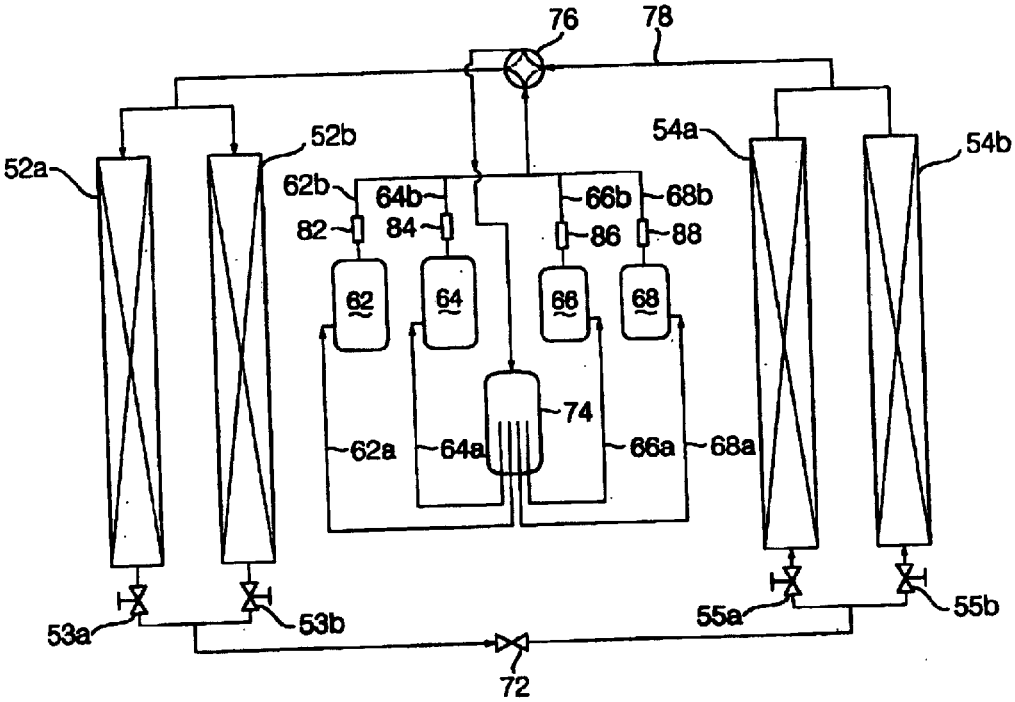
FIG. 8 is a schematic view of another embodiment of the air conditioning system in a heating mode in accordance with the present invention.

FIG. 7 is a schematic view of another embodiment of the air conditioning system in a cooling mode in accordance with the present invention. FIG. 8 is a schematic view of another embodiment of the air conditioning system in a heating mode in accordance with the present invention.

As shown in FIGS. 7 and 8, the air conditioning system of this embodiment of the present invention comprises a plurality of indoor heat exchangers 52*a* and 52*b* connected in parallel and a plurality of outdoor heat exchangers 54*a* and 54*b* connected in parallel. Since, other parts of the air conditioning system in this embodiment except for the plural indoor heat exchangers 52*a* and 52*b* and the plural outdoor heat exchangers 54*a* and 54*b* have the same construction and operation as those in the first embodiment, they are denoted by the same reference numerals even though they are depicted in difference drawings and detailed descriptions thereof will thus be omitted because it is considered to be unnecessary.

Indoor solenoid valves 53*a* and 53*b* for intermittently controlling the flow of the refrigerant in the indoor heat exchangers 52*a* and 52*b* are respectively installed at a side of the refrigerant pipes 78 connected to the indoor heat exchangers 52*a* and 52*b*, respectively.

Further, outdoor solenoid valves 55*a* and 55*b* for intermittently controlling the flow of the refrigerant in the outdoor heat exchangers 54*a* and 54*b* are respectively installed at a side of the refrigerant pipes 78 connected to the outdoor heat exchangers 54*a* and 54*b*, respectively.

In a cooling mode, a refrigerant in a low-temperature and low-pressure state discharged from the expansion device 72 passes through the plural indoor heat exchangers 52*a* and 52*b*, thereby being evaporated. Then, the refrigerant is introduced into the first, second, third and fourth compressors 62, 64, 66 and 68. The refrigerant in a high-temperature and high-pressure state compressed by the first, second, third and fourth compressors 62, 64, 66 and 68 passes through the plural outdoor heat exchangers 54*a* and 54*b*, thereby being condensed. Here, the indoor solenoid valves 53*a* and 53*b* and the outdoor solenoid valves 55*a* and 55*b* are controlled by the operation of an indoor unit (not shown) provided with the indoor heat exchangers 52*a* and 52*b*, thereby allowing a part or all of the plural indoor heat exchangers 52*a* and 52*b* to operate so as to cope with a cooling mode in a room.

In a heating mode, the refrigerant in a low-temperature and low-pressure state discharged from the expansion device 72 passes through the plural outdoor heat exchangers 54*a* and 54*b*, thereby being evaporated. Then, the refrigerant is introduced into the first, second, third and fourth compressors 62, 64, 66 and 68. The refrigerant in a high-temperature and high-pressure state compressed by the first, second, third and fourth compressors 62, 64, 66 and 68 passes through the plural indoor heat exchangers 52*a* and 52*b*, thereby being condensed. Here, the indoor solenoid valves 53*a* and 53*b* and the outdoor solenoid valves 55*a* and 55*b* are controlled by the operation of the indoor unit (not shown) provided with the indoor heat exchangers 52*a* and 52*b*, thereby allowing a part or all of the plural indoor heat exchangers 52*a* and 52*b* to operate so as to cope with a heating mode in the room.

The air conditioning system and the method for controlling the air conditioning system in accordance with the present invention have several advantages, as follows.

First, the air conditioning system of the present invention comprises an indoor heat exchanger for heat-exchanging a refrigerant with air in a room, thereby cooling the room, an outdoor heat exchanger for condensing the refrigerant, a plurality of compressors for compressing the refrigerant, and a control unit for individually controlling the compressors in accordance with a cooling or heating load in the room, thus improving comfortableness in the room, reducing an electric power consumption rate, and increasing cooling or heating efficiency.

Second, the air conditioning system of the present invention further comprises a direction change valve for changing the flow direction of the refrigerant so that the air conditioning system is selectively operated in a cooling or heating mode, thus having both cooling and heating functions.

Third, the plural compressors may include first and second compressors respectively having a capacity of 30% and third and fourth compressors respectively having a capacity of 20% so that the control unit controls the total capacity of the first, second, third and fourth compressors to be one selected from 20%, 40%, 50%, 60%, 70%, 80% and 100%. Accordingly, it is possible to control the operation of the plural compressors in total seven grades, thus allowing the air conditioning system to rapidly cope with the variation of the cooling or heating load in the room, reducing an electric power consumption rate, and increasing cooling or heating efficiency.

Fourth, the plural compressors may include four compressors respectively having the same capacity so that the control unit controls the total capacity of the four compressors to be one selected from 25%, 50%, 75% and 100%. Accordingly, it is possible to control the operation of the plural compressors in total seven grades, to use the compressors in common, and to easily replace the compressors with a new one.

Fifth, the first, second, third and fourth compressors are respectively constant speed compressors, thus having the same effect as an inverter-type compressor with a simple structure and a low production cost.

Sixth, the control unit controls the operation of the first, second, third and fourth compressors in a cooling mode so that the total capacity of operating compressors is one selected from 20%, 40%, 60% and 100%, allowing the air conditioning system to rapidly cope with the cooling load in the room.

Seventh, the control unit controls the operation of the first, second, third and fourth compressors in a heating mode so that the total capacity of operating compressors is one selected from 50%, 70%, 80% and 100%, allowing the air conditioning system to rapidly cope with the heating load in the room.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioning system comprising:

an indoor heat exchanger that cools a room by heat-exchanging a refrigerant with air in the room;

an outdoor heat exchanger that condenses the refrigerant;

at least four compressors that compress the refrigerant; and a controller that starts at least one of the at least four compressors in accordance with one of a determined cooling or heating load in the room.

2. The air conditioning system according to claim 1, further comprising a direction change valve that changes the flow direction of the refrigerant so that the air conditioning system is selectively operated in one of a cooling or heating mode.

3. The air conditioning system according to claim 1, wherein the indoor heat exchanger includes a plurality of unit indoor heat exchangers connected in parallel.

4. The air conditioning system according to claim 1, wherein the outdoor heat exchanger includes a plurality of outdoor heat exchangers connected in parallel.

5. The air conditioning system according to claim 1, wherein the at least four compressors include first and second compressors respectively having a capacity of 30% and third and fourth compressors respectively having a capacity of 20%.

6. The air conditioning system according to claim 1, wherein the at least four compressors include four compressors having the same capacity.

7. The air conditioning system according to claim 1, wherein the at least four compressors are constant speed compressors.

8. The air conditioning system according to claim 1, wherein at least one of the at least four compressors is a variable capacity compressor, and the remaining at least four compressors are constant speed compressors.

9. A method for controlling an air conditioning system comprising:

determining one of a cooling or heating load in a room; and controlling operation of first and second compressors respectively having a capacity of 30% and third and fourth compressors respectively having a capacity of 20% in accordance with the determined one of the cooling or the heating load.

10. The method according to claim 9, wherein controlling further includes differently controlling operating modes of the first, second, third and fourth compressors in accordance with one of a cooling or heating mode.

11. The method according to claim 9, wherein the determining further includes determining the cooling load in the room to be a grade selected from lowest, low, high, or highest grades, when the air conditioning system is operated in a cooling mode; and the controlling further includes controlling an operation of the first, second, third and fourth compressors so that the total capacity of the compressors is selected from one of 20%, 40%, 60%, or 100%.

12. The method according to claim 11, wherein the controlling includes operating one of the third and fourth compressors, when it is determined that the cooling load is in the lowest grade.

13. The method according to claim 11, wherein the controlling includes operating both the third and fourth compressors, when it is determined that the cooling load is the low grade.

14. The method according to claim 11, wherein the controlling includes operating both the first and second compressors, when it is determined that the cooling load is the high grade.

15. The method according to claim 11, wherein the controlling includes operating all of the first, second, third and fourth compressors, when it is determined that the cooling load is in the highest grade.

16. The method according to claim 9, wherein the determining includes determining the heating load in the room to be in one grade selected from one of lowest, low, high, or highest grades, when the air conditioning system is operated in a heating mode; and the controlling includes controlling an operation of the first, second, third and fourth compressors so that the total capacity of the compressors is selected from one of 50%, 70%, 80% or 100%.

17. The method according to claim 16, wherein the controlling includes operating one of the first and second compressors and one of the third and fourth compressors, when it is determined that the heating load is the lowest grade.

18. The method according to claim 16, wherein the controlling includes operating one of the first and second compressors and both the third and fourth compressors, when it is determined that the heating load is the low grade.

19. The method according to claim 16, wherein the controlling includes operating both the first and second compressors and one of the third and fourth compressors, when it is determined that the heating load is the high grade.

20. The method according to claim 16, wherein the controlling includes operating all of the first, second, third and fourth compressors, when it is determined that the heating load is the highest grade.

21. An air conditioning system comprising:

an indoor heat exchanger that cools a room by heat-exchanging a refrigerant with air in the room;

an outdoor heat exchanger that condenses the refrigerant;

a plurality of compressors that compress the refrigerant; and a controller that controls an operation of the plural compressors in accordance with one of a cooling or heating load in the room, wherein the plural compressors include first and second compressors respectively having a capacity of 30% and third and fourth compressors respectively having a capacity of 20%.

* * * * *